United States Patent [19]

Williams

[11] Patent Number: 4,602,712

[45] Date of Patent: Jul. 29, 1986

[54] CREDIT CARD CONTAINER

[76] Inventor: Theodore P. Williams, 2815 Martin Ave., Bellmore, N.Y. 11710

[21] Appl. No.: 750,737

[22] Filed: Jul. 1, 1985

[51] Int. Cl.[4] ..... A45C 11/18

[52] U.S. Cl. ..... 206/39; 206/1.5; 206/37; 229/8.5

[58] Field of Search ..... 206/39, 37, 1.5, 359; 229/8.5

[56] References Cited

U.S. PATENT DOCUMENTS

| | | | |
|---|---|---|---|
| 182,826 | 10/1876 | Hoard | 229/8.5 |
| 912,804 | 2/1909 | Brush | 206/39.6 |
| 1,091,333 | 3/1914 | Heidel | 229/8.5 |
| 2,330,478 | 9/1943 | Englert | 229/8.5 |
| 2,420,125 | 5/1947 | Crist | 206/1.5 |
| 2,792,933 | 5/1957 | Butlin | 206/359 |
| 3,113,711 | 12/1963 | Janus | 229/8.5 |
| 4,045,102 | 8/1977 | Austin | 312/61 |
| 4,106,620 | 8/1978 | Brimmer et al. | 206/359 |
| 4,305,497 | 12/1981 | Pacilio | 206/39 |

*Primary Examiner*—William Price
*Assistant Examiner*—Brenda J. Ehrhardt
*Attorney, Agent, or Firm*—Richard L. Miller

[57] ABSTRACT

The instant invention is a one piece, transparent plastic, hollow cube having a slot on top for receiving a conventional credit card. The slot is such that it forces the card to deform slightly while passing there through, so that the card can not be removed without shattering the cube.

2 Claims, 5 Drawing Figures

CREDIT CARD CONTAINER

BACKGROUND OF THE INVENTION

This invention relates generally to credit card accessories. More specifically it relates to card container, and is an improvement, for its intended purpose,, over the art as presented in U.S. Pat. Nos.: 4,045,102 to Austin; 4,305,497 to Pacilio; and 912,804 to Brush.

It is well known that credit cards promote sales because people tend to buy more than they otherwise would when they do not have to pay out cash at the time of the purchase. The general feeling is that by the time the payment will be due they will have the money. However sometimes such over buying causes financial stress when the payment becomes due, so that persons tend to blame their problem on their possession of a credit card. Had it not been available, they now would have no problem. This situation is objectionable and therefore in need of an improvement.

SUMMARY OF THE INVENTION

Accordingly it is a principal object of the present invention to provide a credit card container inside which a credit card may be virtually held as a prisoner so as to not be freely available for use, but when in case of absolute necessity for some purchases, the container can be broken open in order to release the card.

Another object is to provide a credit card container which accordingly will train persons to resist impulse purchasing when their credit card is not freely available.

Yet another object is to provide a credit card container that is a hollow cube molded form transparent plastic into a single part, and from which the card cannot be removed without shattering the cube into pieces; the theory being that the person will be reluctant to destroy the cube and thereafter need to again replace it with another purchased one.

Yet a still further object is to permit the card to be used for identification purposes such as when cashing a check while at the same time preventing the card from actually being used by dishonest store personal in charging a false sale to a persons account.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF PREFERRED EMBODIMENTS

Figure 3:
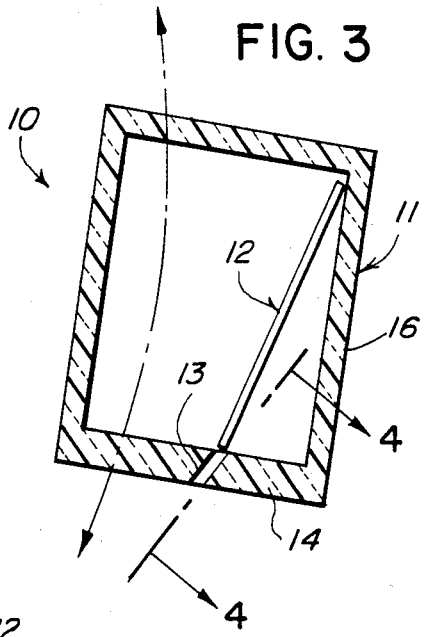
FIG. 3 is a similar cross sectional view showing the inability of the card to be outwardly removed through the slot even when the container is inverted and shaken.
Figure 2:
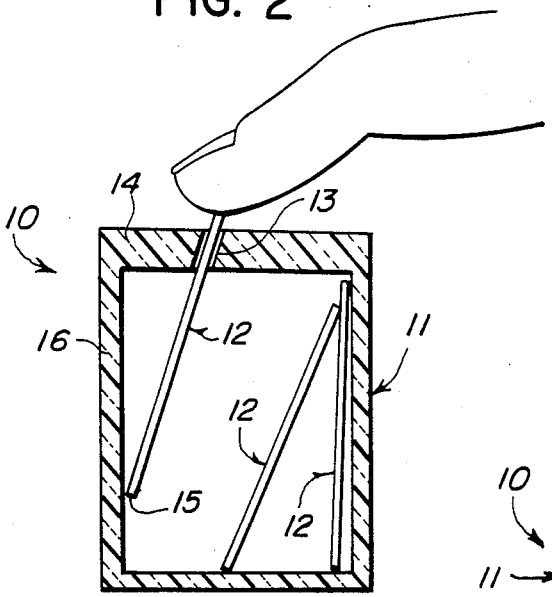
FIG. 2 is a cross sectional view taken on line 2—2 of FIG. 1, showing a card being inserted through the container's slot.
Figure 4:
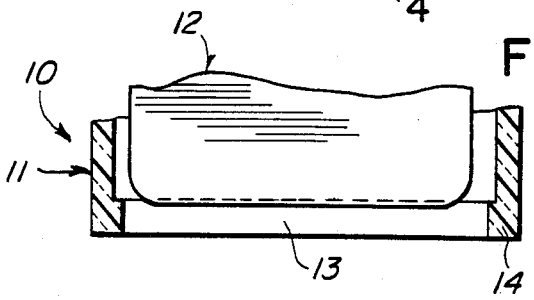
FIG. 4 is a cross sectional view taken on line 4—4 in FIG. 3.

Referring now to the drawing in greater detail, and more particularly to FIGS. 1 through 4 thereof at this time, the reference numeral 10 represents a credit card container, according to present invention wherein the same comprises a hollow cube 11 molded as a single part from transparent plastic. The dimensions of the cube are such so as to receive a standard sized credit cards 12 therewithin, and which is received through a narrow slot 13 upon a top side of the cube. The top wall 14 is of substantial thickness in order that the slot extends angularly therethrough, as best shown in FIGS. 2 and 3, so that when a flat credit card is inserted therein, the leading edge 15 of the card abuts against a front wall 16 during the insertion, and thus necessitates the card to bend slightly before fitting entirely inside the cube. The card straightens out again therewithin, thus preventing it from re-entering the slot and being removed out of the cube, even if inverted and shaken, as shown in FIG. 3. Removal of the card is possible only by shattering the cube.

Figure 1:
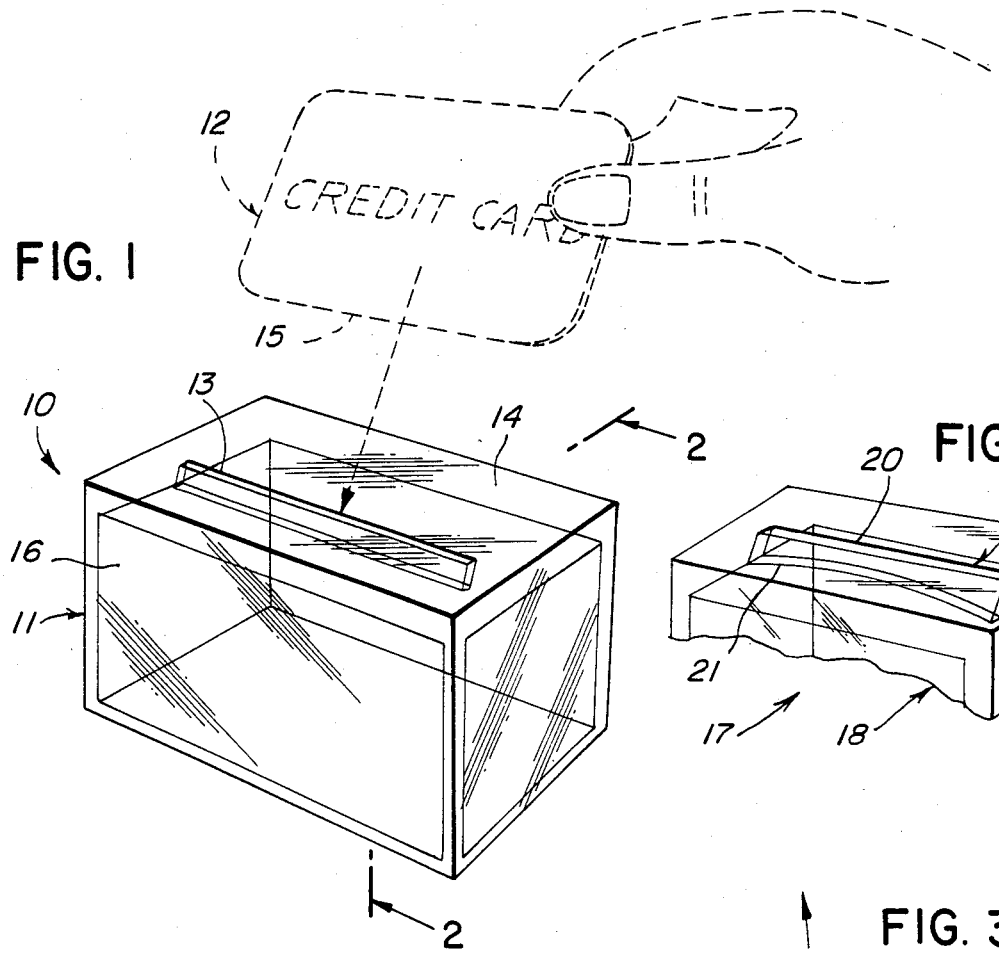
FIG. 1 is a perspective view of the invention shown with a credit card positioned for insertion into the container.
Figure 5:
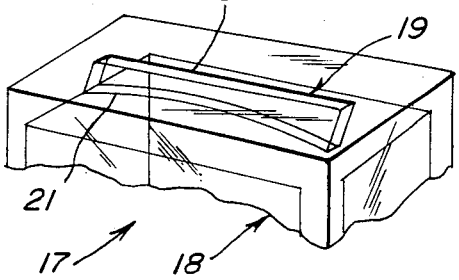
FIG. 5 is a fragmentary perspective view of a modified design of the invention wherein the card entry slot is curved on its inner side so that a flat card cannot re-enter the slot from within the container, for removal.

Referring now to FIG. 5, a modified design of credit card container 17 is shown to comprise a single part, transparent plastic cube 18 having a slot 19 which along its outer edge 20 is straight in order to receive the incoming flat card, but which on its inner edge 21 is curved so as to prevent the re-straightened card from re-entering the slot when inside the cube for removal. The slot accordingly may have its opposite side ends to extend angularly through the top wall, a same as in the embodiment of 10, however the longitudinally center portion of the slot extends vertically therethrough.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A credit card container, comprising, in combination, a hollow cube made of fracturable transparent material and having a narrow slot through a top wall of said cube for receiving a conventional flat credit card therethrough into an interior of said cube, means including said slot being angularly inclined toward one side wall of the cube and offset spaced in the top wall so as to be closer to said one side wall, to effect the card being forced to abut said one side wall during entry through said slot and necessitating being flexed for full entry into the cube, the height of the cube being greater than the height of the card, whereby once the card is entered it can be retained in the cube in an upright, unflexed condition, and is not outwardly removable through the slot.

2. A credit card container as in claim 1, where only the side ends of said slot are angularly inclined, with the longitudinal center position of the slot extending vertically through the top wall, such that the card must be curved while going through the slot.

* * * * *